US005129537A

United States Patent [19]

Bordner et al.

[11] Patent Number: 5,129,537

[45] Date of Patent: Jul. 14, 1992

[54] TWO-PIECE POLYMERIC LID CLAMPING RING

[76] Inventors: Paul G. Bordner, 7803 Fairlawn Dr., Pickerington, Ohio 43147; Richard P. Brandt, 1152 Windslow Cir., Crystal Lake, Ill. 60014

[21] Appl. No.: 789,612

[22] Filed: Nov. 8, 1991

Related U.S. Application Data

[63] Continuation of Ser. No. 713,753, Jun. 11, 1991, abandoned.

[51] Int. Cl.[5] ..... B65D 45/34

[52] U.S. Cl. ..... 220/321; 220/320; 292/256.69

[58] Field of Search ..... 220/321, 320, 214; 292/256.69, 256.65, DIG. 49

[56] References Cited

U.S. PATENT DOCUMENTS

| | | | |
|---|---|---|---|
| 869,177 | 10/1907 | Hathaway | 292/256.69 X |
| 2,082,881 | 4/1936 | Fetter . | |
| 2,368,758 | 2/1945 | Grotnes . | |
| 3,045,857 | 7/1962 | Lineweber | 220/321 X |
| 3,633,956 | 1/1972 | Angell . | |
| 4,267,940 | 5/1981 | Wade | 220/321 |
| 4,395,796 | 8/1983 | Akaura et al. . | |
| 4,678,216 | 7/1987 | Gregory | 292/256.69 |
| 4,718,571 | 1/1988 | Bordner . | |
| 4,805,798 | 2/1989 | Stolzman | 220/320 X |

*Primary Examiner*—Stephen Marcus
*Assistant Examiner*—Paul A. Schwarz
*Attorney, Agent, or Firm*—Mueller and Smith

[57] ABSTRACT

A clamping ring for retaining a lid upon an enclosure such as a fibrous drum is provided which is formed entirely of polymeric material such as a high molecular weight, high density polyethylene copolymer. The assemblage includes only two parts, a channel formed split ring and a pivot arm joining the two ends of the split ring together over the rim structure of the container. One end of the ring supports an integrally formed pivot shaft receiving notch and the opposite end of the ring is configured having a receiver channel with spaced-apart sides and an outwardly disposed opening. The inwardly-facing internal surfaces of the receiver channel are slideably movable in adjacency over the side surfaces of the opposite side of the ring and a ring pivot shaft extends between the spaced-apart sides of the receiver channel. The pivot arm cooperates with the split ring and has a pivot end formed with a transversely disposed arm pivot shaft and a ring shaft receiving notch spaced therefrom. The arm pivot shaft is configured for slideable engagement with the ring receiving notch and the ring shaft receiving notch is configured for slideably receiving the ring second end pivot shaft.

20 Claims, 4 Drawing Sheets

TWO-PIECE POLYMERIC LID CLAMPING RING

This application is a continuation of application Ser. No. 07/713,753, filed Jun. 11, 1991, now abandoned.

BACKGROUND OF THE INVENTION

Cylindrical containers intended for retaining chemicals, industrial materials, and the like are structured in generally common fashion by fabricators. Their size and the materials from which they are formed vary substantially. However, those formed of plastic, cellulosic or fibrous materials vary in capacity from 3 gallon plastic pails to 55 gallon fiber, plastic or metal drums. Generally, to enhance container strength, as well as to facilitate the attachment of a lid, the rims of the pails or drums are reinforced with annular metal chimes formed having a rim bead and an inwardly-extending region or groove just below the bead. For most designs, the formation of the groove effects a deforming securement of the rim to the drum wall. Lids typically enclosing the drums are formed as stamped metal or plastic components which are secured over the rim-chime assemblies with metal split ring clamps having a channel or U-shaped cross-section, the lower inwardly turned side or edge of which engages the rim groove and the upper side of which abuts over the lid top. An overcenter lever generally is used to draw the ends of the split ring structure together. For many packaging, transportation, and incineration container applications, industrial users of such structures have sought to avoid metal components such as lids and lid retainers, for example split ring clamp devices. These metal devices do not burn, are prone to corrode or, importantly, to insert minute metallic contaminants with material packaged within the containers. While plastic lids have been developed, for example as described in U.S. Pat. No. 4,718,571, the development of a plastic clamping ring which remains competitive in terms of both cost and securement performance has been elusive to investigators.

Fiber based drums as well as plastic containers, when filled, will be warehoused and transported by personnel employing hand carts, forklifts and like devices. Thus, from time to time, the filled containers may accidentally be dropped varying distances upon hard surfaces. Upon the occurrence of such dropping accidents, the containers, typically weighing in the range of 50 to 500 pounds, will be highly strained and somewhat deformed during impact. To assure a secured retention of the lid retained drum contents, designs for the lid securing structures are tested. For example, specifications have been promulgated by a variety of commercial, international and government entities and the United States Department of Transportation (DOT), Research and Special Programs Administration. See generally 49 CFR CH. (Oct. 1, 1988 Edition), Section 178.244-2. Typically, drop tests are called for by the test procedures wherein samples taken at random are filled with dry finely powdered material to authorized net weight and closed as for use. The containers, inter alia, must withstand a drop tests of varying heights upon specified parts without leakage or serious rupture. In one such drop, the top chime is directed diagonally onto solid concrete. In another test, the bottom of the container is dropped diagonally such that the bottom chime contacts solid concrete.

While drum-lid assemblies along with split clamping rings have met the specifications as above, heretofore, such specifications have been met with metal split clamp rings. These metal rings generally are formed of multiple parts, with the clamping components being riveted to the metal channel shaped ring portions. This multitude of parts may vary in number, for example, from about 7 to 13. Implementation of the devices with all-plastic material requires the elimination of parts to achieve a cost competitiveness. Additionally, the plastic devices should be capable of meeting securement specifications, such as those discussed above. However, it has been the experience of investigators that plastic split ring clamping assemblies are prone to fail the drop-based securement or drop tests.

SUMMARY

The present invention is addressed to a split ring clamp for retaining a lid upon the rim of a cylindrical container which is formed of a polymeric material. While providing the advantageous attributes of a non-contaminating and non-corroding plastic material, the lid retaining assemblies may be produced by the molding of only two pieces. Thus, while providing the enhanced attributes of plastic structuring, the retainer assemblage remains competitive in terms of cost with respect to metal clamp assemblies. The plastic material from which the clamps are formed is recyclable and may be U.V. stabilized by the incorporation of a U.V. screen. No sharp edges are developed upon the molded plastic clamps, thus they are more safe during handling.

In a preferred embodiment, the two-piece split ring clamp structures exhibit important lid retention integrity under dynamic shock conditions. This resilience of the retention assemblies to impact based shock conditions is demonstrated, for example, by their performance under drop test criteria.

Another feature of the invention is to provide a split ring clamp for retaining a lid upon the rim of a cylindrical container at the interface therebetween. The clamp includes an inwardly opening channel-form ring formed of polymeric material having a first end with oppositely disposed side surfaces and within which is integrally formed an outwardly extending, rearwardly opening pivot shaft receiving notch. The ring has an oppositely disposed second end including an integrally formed receiver channel having oppositely disposed, spaced apart sides defining an outwardly disposed opening and having mutually inwardly facing internal surfaces slideably movable in adjacency over the side surfaces of the first end. The ring further includes a ring pivot shaft extending between the spaced apart sides of the receiver channel at the outwardly disposed edges thereof. A pivot arm is provided having a pivot end formed with a transversely disposed arm pivot shaft, a ring shaft receiving notch having a shaft access opening extending to a shaft bearing surface spaced from the arm pivot shaft a distance selected for drawing together the ring first and second ends, and extending therefrom to form a lever. The arm pivot shaft is configured for slideable engagement with the ring first end receiving notch and the ring shaft receiving notch is configured for slideably receiving the ring second end pivot shaft.

Another feature of the invention provides a two-piece split ring clamp. The clamp includes an inwardly opening channel-form split ring formed of polymeric material having an outward surface and oppositely disposed, spaced apart surfaces, having a first end, a rearwardly opening pivot shaft receiving notch upstanding from and formed integrally with the outward surface adjacent the first end. The ring has a second end wherein an integrally formed receiver channel is provided having oppositely disposed, spaced-apart sides defining an outwardly disposed opening and further having mutually inwardly facing internal surfaces slideably movable into nesting adjacency over the spaced side surfaces and outward surface of the first end. A ring pivot shaft is integrally formed with the receiver channel extending between the spaced-apart sides thereof at the outwardly disposed edges thereof. A pivot arm is provided formed of polymeric material having a pivot end including an integrally formed, transversely disposed arm pivot shaft inserted within and pivotally movable about the receiving notch of the split ring. A ring shaft receiving notch is formed within the pivot arm having a shaft access opening and extending to a shaft bearing surface spaced from the arm pivot shaft a distance selected for drawing together the split ring first and second ends, the shaft bearing surface being pivotally engaged with the ring pivot shaft and the pivot arm extending to an integrally formed lever portion.

Another feature of the invention provides, in a container assembly wherein a cylindrical container is provided having a bottom and cylindrical sidewalls extending therefrom to a top portion including a rim structure having an upwardly disposed rim bead, an outwardly disposed side surface portion and an inwardly extending engaging region formed inwardly of and below the rim bead and having an upper contact surface, and wherein a lid is provided having a circular peripheral portion positioned over the rim bead in nesting, container closing fashion, the improved split ring clamp for retaining the lid upon the rim structure which includes an inwardly opening, channel-form split ring formed of polymeric material, having oppositely disposed sides and a top, one of the sides being positionable in abutting adjacency against the upper contact surface and the side opposite thereto being positionable in abutting adjacency against the lid peripheral portion, the ring having a first end upon which an outwardly extending, rearwardly opening pivot shaft receiving notch is integrally formed. The ring has an oppositely disposed second end including an integrally formed receiver channel having oppositely disposed, spaced apart channel sides defining an outwardly disposed opening and having mutually inwardly facing internal surfaces slideably movable in adjacency over the sides at the first end, and including a ring pivot shaft extending between the spaced-apart sides at the oppositely disposed edges thereof. A pivot arm is provided formed of polymeric material, having a pivot end formed with a transversely disposed arm pivot shaft, a ring shaft receiving notch having a shaft access opening extending to a shaft bearing surface spaced from the arm pivot shaft a distance selected for drawing together the ring first and second ends to effect securement of the lid upon the rim structure, and extending therefrom to form a lever handle. The arm pivot shaft is slideably engaged with the ring first end receiving notch and the ring shaft receiving notch slideably receives the ring second end pivot shaft.

Other objects and features of the invention will, in part, be obvious and will, in part, appear hereinafter.

The invention, accordingly, comprises the apparatus possessing the construction, combination of elements, and arrangement of parts which are exemplified in the following detailed disclosure. For a fuller understanding of the nature and objects of the invention, reference should be had to the following detailed description taken in connection with the accompanying drawings.

DETAILED DESCRIPTION OF THE INVENTION

Figure 1:
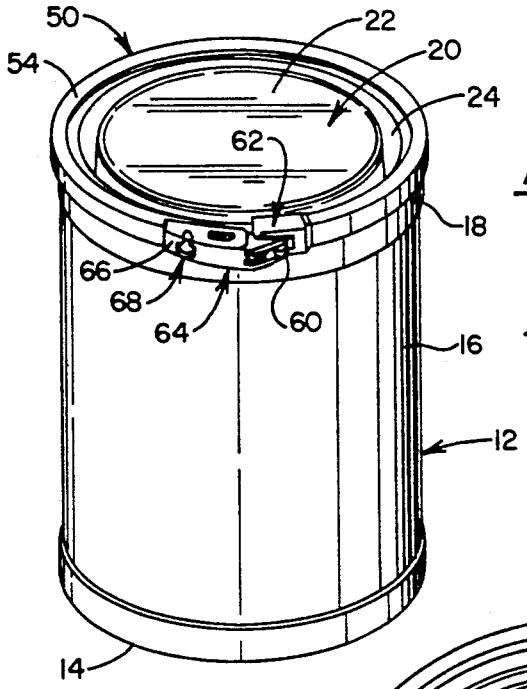
FIG. 1 is a perspective view of a drum type container and lid assembly utilizing a two-piece ring clamp closure according to the invention.

Referring to FIG. 1, an assembly comprised of a drum type container of a fibrous variety, a lid, and enclosing split clamp ring fashioned according to the invention is revealed generally at 10. The drum 12 includes a bottom portion 14 which may include a reinforcing metal chime structure and from which extends a cylindrically shaped sidewall 16 which, in turn, terminates at the top of the container with a rim structure including a metal chime 18, the lowermost portion of which is revealed in the figure. Drum 12 is shown to be closed by a lid represented generally at 20 which, for many applications, is preferred to be formed of a plastic material, for example, such as an integrally molded polyolefin.

Figure 2:
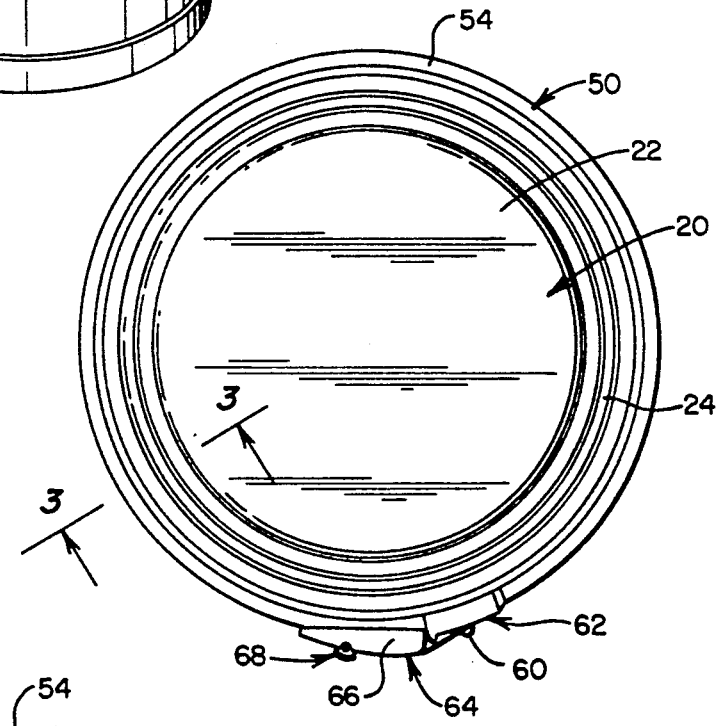
FIG. 2 is a top view of the assembly of FIG. 1.
Figure 3:
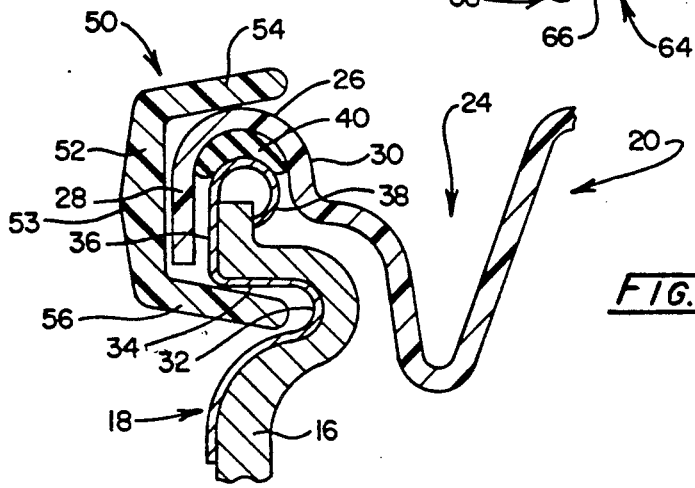
FIG. 3 is a partial sectional view taken through the plane 3—3 in FIG. 2.

Looking additionally to FIGS. 2 and 3, lid 20 is seen to be formed having a flat upper surface 22 which transitions to define an annular undulation or accordion-like structure 24 which recovers upwardly to an annular lid rim 26 which then extends outwardly and downwardly to form a lid skirt 28.

The rim structure of the drum 12 is shown in general at 30 and includes the earlier-described metal chime 18 which is configured in conjunction with the drum sidewall 16 to provide an inwardly extending engaging region or groove 32 having an upper contact surface 34.

Chime 18 and drum sidewalls 16 further are configured to define a side surface portion 36 and the chime extends upwardly therefrom in encircling fashion to define an upwardly-disposed rim bead 38. The underside of the annular lid rim 26 is seen to be nested over rim bead 38 and intermediate those components is a flexible gasket 40 formed of rubber or suitable polymer. Lid 20 is secured to the rim structure 30 of the drum 12 by a two-piece split ring clamp represented generally at 50 which, in accordance with the invention, is formed of a polymeric material, for example, a high molecular weight, high density polyethylene copolymer such as a type HYA-024 marketed by Mobil Polymers U.S., Inc. The material exhibits excellent impact strength and stress crack resistance suited for high performance tank and drum applications. For added integrity and endurance under adverse sun conditions, the material may incorporate a U.V. (ultra violet) screen. FIG. 3 shows the ring component of the split ring 50 to have an outward surface 52 formed integrally with oppositely disposed spaced side surfaces 54 and 56. The ring 50 is of an inwardly opening channel form configured o exhibit a truncated V cross-section. It may be observed that as the ring is drawn against the lid rim 26 and upper contact surface 34, a compressive retention of the lid 20 is provided against the rim structure 30. To enhance the tensile strength of ring 50, the center of outward surface 52 is formed with an enhanced thickness to define a ridge 53.

FIGS. 1 and 2 reveal the structuring which provides for this ring tension of the lid 20 upon the drum 16. Note in this regard that a first end of the split ring is provided and adjacent thereto is a pivot shaft receiving notch seen generally at 60. At the second end of the split ring is an integrally formed receiver channel represented generally at 62. The first and second ends are drawn together through the functioning of a pivot arm represented generally at 64. Pivot arm 64 includes a lever 66 shown configured as a handle which, upon the pivot arm 64 being closed, nests inwardly over the outer surface 52 and side surfaces 54 and 56 of the ring component. A locking detent assembly is shown generally at 68 which serves the purpose of retaining the lever 66 in its closed orientation.

Figure 4:
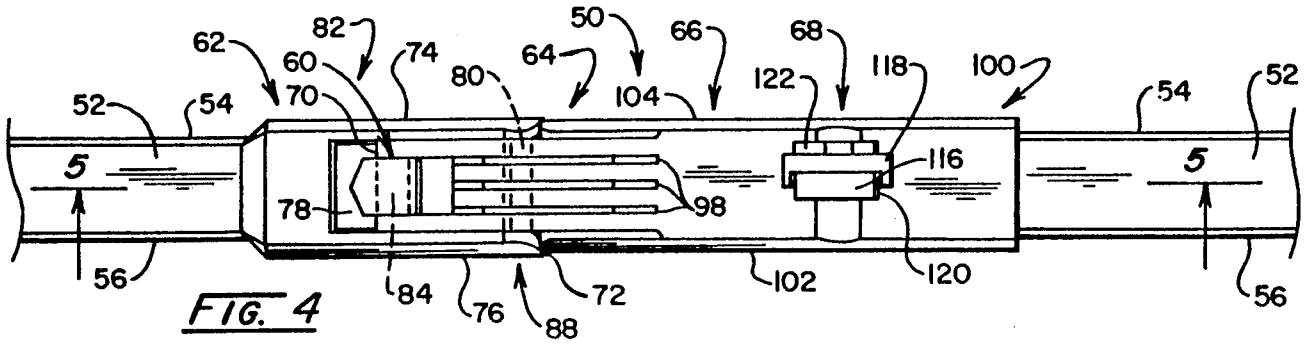
FIG. 4 is a partial side view of the two-piece split ring clamp of the invention showing the pivot arm thereof.
Figure 5:
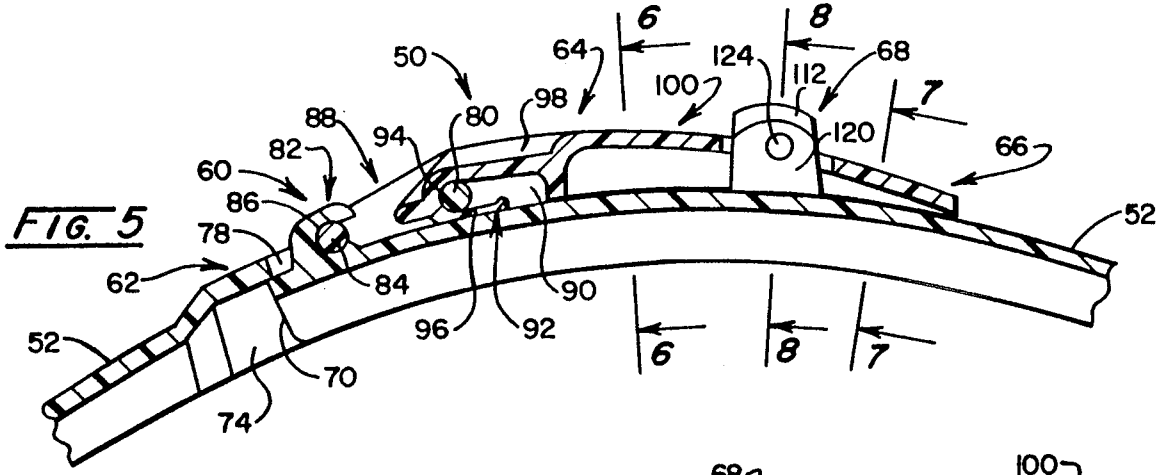
FIG. 5 is a sectional view taken through the plane 5—5 in FIG. 4.

Referring to FIGS. 4 and 5, the structure of pivot arm 64 as it is associated with the split ring component is revealed at a higher lever of detail. In the figures, the noted first end of the split ring at 70 is seen to be slideably received within the receiving channel 62 formed adjacent the second end 72 seen in FIG. 4. The receiver channel is shown in FIG. 4 as including oppositely disposed, spaced apart sides 74 and 76 which define an outwardly disposed rectangularly shaped opening 78. A ring pivot shaft 80 is integrally formed with the receiver channel 62 and extends between the spaced apart sides 74 and 76 thereof at second end 72. Note that the location is at the outward edge of those sides 74 and 76, outward being considered with respect to the sidewall 16 of drum 12.

Pivot arm 64 preferably is formed of a polymeric material which may be the same material as employed for the ring structure. Preferably formed by injection molding, it exhibits a somewhat channel-like shape having a pivot end 82 formed with a transversely disposed and integrally formed arm pivot shaft 84. FIGS. 4 and 5 show that this arm pivot shaft 84 is received and pivotally engaged within the rearwardly opening pivot shaft receiving notch 60. Notch 60 is formed having a curved bearing surface 86 of diameter corresponding with the diameter of arm pivot shaft 84. However, the notch opening is of an extent less than the diameter of the shaft 84 so as to provide for a flexural capture of the arm pivot shaft 84 upon its slideable insertion into the notch.

Figure 7:
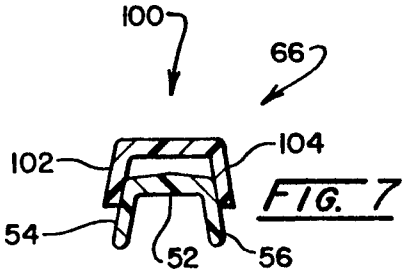
FIG. 7 is a sectional view taken through the plane 7—7 shown in FIG. 5.
Figure 6:
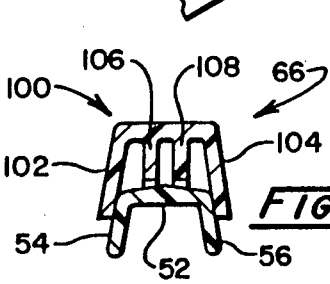
FIG. 6 is a sectional view taken through the plane 6—6 shown in FIG. 5.

From integrally formed arm pivot shaft 84, the pivot arm 64 extends along what is termed an elongate capture region 88 which extends to the access opening 90 of a ring shaft receiving notch 92 (FIG. 5). Notch 92 extends to a shaft bearing surface 94 which serves to pivotally receive the ring pivot shaft 80. Note that the capture region is particularly defined by the inwardly disposed notch extension 96 seen in FIG. 5. This capture region 88 and particularly, the notch extension 96 thereof contributes to rendering the clamp 50 immune from dynamic shock conditions which may be imposed upon it by testing or otherwise. Note that the extension 96 slideably retains the alignment of the ring pivot shaft 80 with the shaft bearing surface 94 under such conditions. The extension 92 also serves the function of providing for a more elongate separation of ring ends 70 and 72. Pivot arm 64 further is configured having parallel side surfaces intermediate the arm pivot shaft 84 and the shaft access opening 90 which are spaced apart a distance which permits the pivotal sliding movement of that portion of the arm 64 within the receiver channel 62 and, particularly, within the outwardly disposed opening 78 formed therein. These spaced side surfaces of the arm 64 also are seen to be of lesser widthwise extent and are reinforced by small ribs as at 98 seen in FIG. 4. This dimensioning of lesser extent at the capture region 88 permits a flexure of the arm, again permitting its accommodation to dynamic shock effects such that the ring is not destroyed or loosened during such phenomena. From the ring shaft receiving notch 92, the pivot arm 64 extends to form a lever or handle 100 which is, again, fashioned in the form of an inwardly opening channel such that it might slide over the upper surface 52 and sides 54 and 56 of the ring structure. Looking to FIG. 6, this lever portion 100 is seen to be formed having lever sides 102 and 104 which nest downwardly over corresponding sides 54 and 56 of the ring structure. Note that the lever structure 100 is rounded off at each side 102 and 104. For example, a radius 101 is molded within side 102. Lever component or portion 100 also may be reinforced internally with ribs as are represented at 106 and 108. FIG. 7 also shows this nesting arrangement of the pivot arm sides 102 and 104 over the corresponding ring structure sides 54 and 56 near the end of the lever 66. By providing this nesting association between the lever 66 and the ring structure, an over-center compressive stress is promoted within the pivot arm between the arm pivot shaft 84 and the shaft bearing surface 94. This, of course, aids in the maintenance of a closed orientation for the clamp 50.

Figure 8:
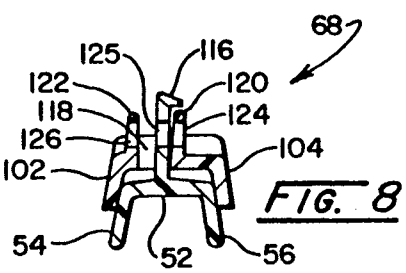
FIG. 8 is a sectional view taken through the plane 8—8 shown in FIG. 5.

FIG. 8 reveals the structuring of the locking detent assembly 68. In this regard, an upstanding locking detent is integrally molded within the outward surface 52 of the ring structure. The detent is seen to be slightly off center with respect to the surface 52 and is positioned and configured such that it extends through a rectangular opening 118 within lever 66 to engage the outwardly disposed edge of an upstanding tab 120 integrally formed within the lever 66. A corresponding tab 122 is provided at the opposite side of the opening 118 and respective circular openings 124–126 are seen formed in components 120, 116, and 122 for purposes of receiving a locking tie or the like for restraining the lever 166 to remain in the noted closed orientation.

Figure 11:
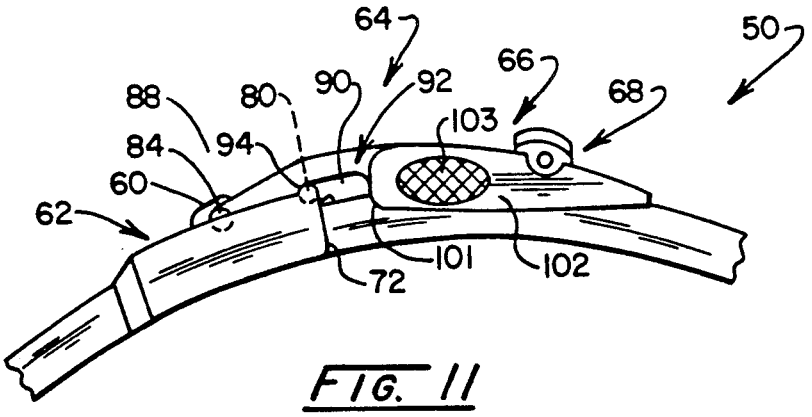
FIG. 11 is a partial side view of the clamp of FIG. 9 showing it in a channel orientation.
Figure 10:
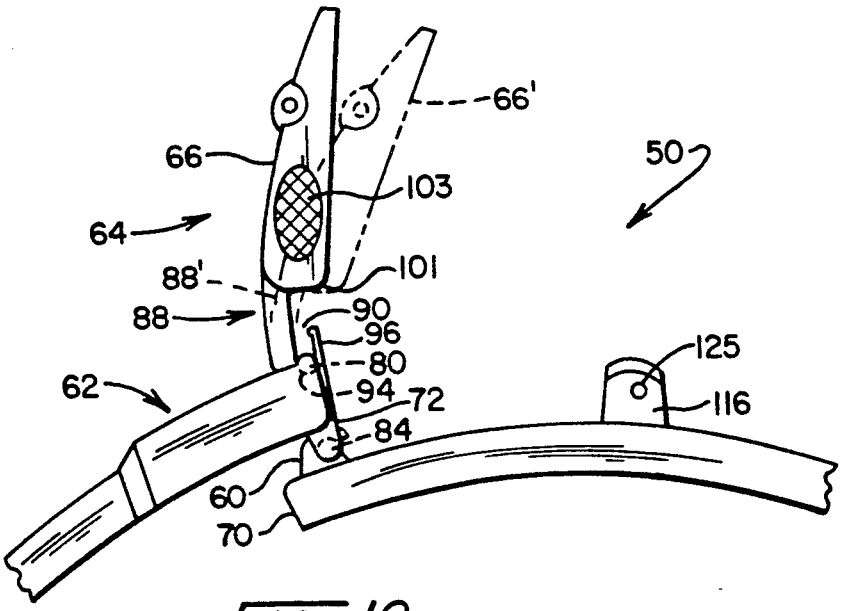
FIG. 10 is a partial side view of the clamp of FIG. 9 showing its orientations while being closed.
Figure 9:
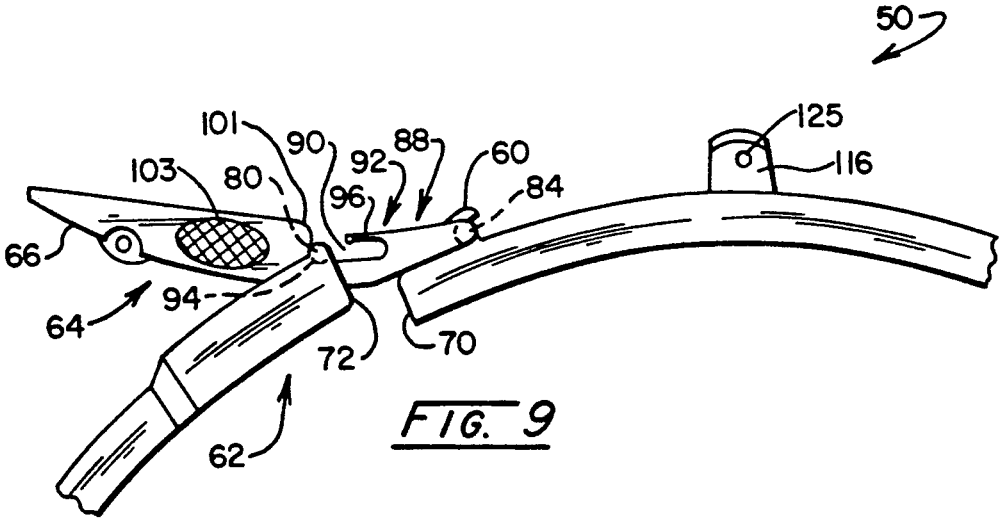
FIG. 9 is a partial side view of the two-piece split ring clamp of the invention, showing an open orientation thereof.

FIGS. 9–11 illustrate the closure and flexure characteristics of the two-piece split ring clamp assembly 50. Looking to FIG. 9, the assembly 50 is shown in the orientation generally assumed during the procedure for installing it upon the rim-lid interface of a drum assembly 10. The figure shows that the arm pivot shaft 84 has been inserted within the pivot shaft receiving notch 60. This insertion will involve a resilient give on the part of the notch 60 so as to, in effect, capture the shaft 84. Ring pivot shaft 80, coupled to the receiver channel 62, is shown having been inserted or positioned at the access opening 90 of ring shaft receiving notch 92. Thus, the elongate ring shaft 92 provides for a greater freeway or spacing between the ends 70 and 72, a feature found convenient particularly where smaller container sizes are involved. A ridged or knurled region is formed within each of the lever sides 102 and 104. This aids gripping the lever 66. Such a region formed within lever side 102 is shown at 103. The assemblage 50 in the orientation shown in FIG. 9 is positioned over the noted container rim-lid interface and, as shown in FIG. 10, the lever 66 then is pivoted about the arm pivot shaft 84 to draw the ends 70 and 72 in mutually oppositely disposed directions while foreshortening the circumference of the ring structure to effect its tightening about the rim-lid interface. As this procedure of drawing the ends together occurs, ring pivot shaft 80 commences to slide toward shaft bearing surface 94 along the notch extension 92 by a camming action against the outwardly disposed side of the notch 92. As this procedure occurs, a flexure is evidenced in the pivot arm 64 in the vicinity of the elongate capture region 88. This flexure is represented in phantom in FIG. 10. In this regard, the flexure within the elongate capture region 88 is shown at 88' and a resultant orientation of the lever 66 is represented in phantom at 66'. Continued rotation of the pivot arm 64 is carried out until the orientation of the two components of the clamp ring 50 assembly as represented in FIG. 11 are achieved. As this occurs, the elongate capture region 88 or the region of the pivot arm 64 between shaft 84 and shaft bearing surface 94 are in compression. This compressive latch state is enhanced by an over-center alignment of the shafts 80 and 84 by virtue of the earlier-described nesting or overlapping of the sides as at 102 and 100 of lever 66 over the top surface 52 of the ring structure. The overlapping feature of the handle 66 also serves to provide a more even compression of gasket 40 (FIG. 3).

The elongate capture region 88 as defined, in particular by the notch extension 96, as well as the noted flexural aspect of the design at hand result in a polymeric two-piece ring clamp assembly 50 having unusually good operational characteristics for remaining intact and retaining a lid at the rim-lid interface under dynamic shock conditions.

The assemblies as at 50 may be subject to a variety of tests or requirements posed by various national, international and commercial regulations or similar requirements. In particular, it may be desirable that the assemblies comply with the regulations for fiber and plastic drums which include: (1) a uniform freight classification (USC), Rule 40; (2) national motor freight classification (NMFC), appropriate rules; (3) Department of Transportation specifications (DOT); and (4) international (United Nations) regulations pertaining to the shipment of goods overseas. The following test procedures have been carried out with respect to the assembly 50.

GENERAL PROCEDURE

1. A new container is filled with a mixture of sand and sawdust to reach rated capacity of the container. This ratio of sand and sawdust is adjusted so head space is between 1 and 2 inches in a 55 gallon drum. In smaller containers, the head space is adjusted to reflect 2% of the capacity of the container or drum.

2. All tests are performed in a remote area of the plant in which they are conducted, with access blocked, to assure maximum protection for plant employees.

3. The testing equipment includes:

(a) a chain and drop hook assembly;
(b) a forklift truck or overhead crane;
(c) hook and strap to achieve correct angle;
(d) clear concrete floor to drop on; and
(e) a pallet, double faced.

TEST DESCRIPTION

Use one drum for each test, except as noted:

(a) Tip over: (NMFC, UFC) place drum on pallet with bottom edge of drum approximately 2 inches from the edge of the pallet. Orient the lock band so the handle will impact the test surface first. Tilt drum to balance point, hold until stabilized and release. No leakage of material is allowed. For dry or liquid products.

(b) Bottom diagonal 2 feet drop: (NMFC, UFC) Using a chain and drop hook assembly in combination with the hook and strap, lift container at a 45 degree angle, with the bottom downward 2 feet from the floor. Drop on bottom corner. Use the same container as test (a). No leakage of material is allowed. For dry or liquid products.

(c) Top diagonal 4 feet drop: (DOT) Using a chain and drop hook assembly in combination with the hook and strap, orient the drum so the handle of the lock band is facing downward. Lift the drum at a 45 degree angle, with the top downward, 4 feet from the floor. Drop on handle. No leakage of material is allowed.

(d) Bottom diagonal 4 feet drop: same as top diagonal.

(e) Other testing to be determined as need arises.

TESTS CONDUCTED

The following tests were conducted using fiber drums having metal top and bottom chime structures and incorporating a polymeric split ring assembly formed substantially as described herein in conjunction with FIGS. 1–11.

FIRST SEQUENCE OF TESTING UTILIZING CONTAINER AT 250 LBS

The first test sequence was a tip over test to assure compliance with both Uniform Freight Classification and National Motor Freight Classification regulations. The drum is a 30 gallon fiber drum filled to 98% capacity with sand and sawdust. Net weight of the container is 250 lbs. Impact is directed to the lock mechanism of the band. A safety seal manufactured by E. J. Brooks was used to secure the band.

Result: Pass.

The second test was a 4 feet top diagonal drop with the drum oriented so the lock mechanism of the band, the weakest point of any band assembly is oriented to impact first.

Result: Pass.

SECOND SEQUENCE OF TESTING WITH CONTAINER AT 550 LBS

The second test sequence, identical to the first, was a tip over test to assure compliance with both Uniform Freight Classification and National Motor Freight Classification criteria. the drum is a 55 gallon fiber drum filled to 98% capacity with sand and sawdust. Net weight of the container is 550 pounds. Impact is directed to the lock mechanism of the band. A safety seal manufactured by E. J. Brooks is used to secure the band.

Result: Pass

The second test was a 4 feet top diagonal drop with the drum oriented so the lock mechanism of the band, the weakest point of any band assembly is oriented to impact first.

Result: Pass.

The above tests show the highly satisfactory performance exhibited by the assemblies 50 which lends the use of these plastics split ring assemblies to a variety of applications.

Figure 13:
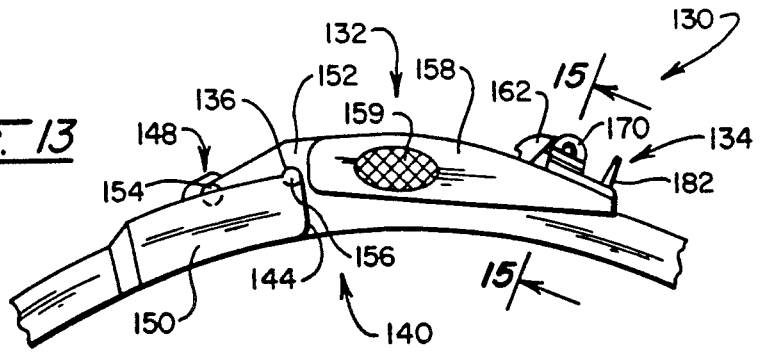
FIG. 13 is a view of the split ring clamp assembly of FIG. 12 showing the pivot arm thereof in a closed position.
Figure 12:
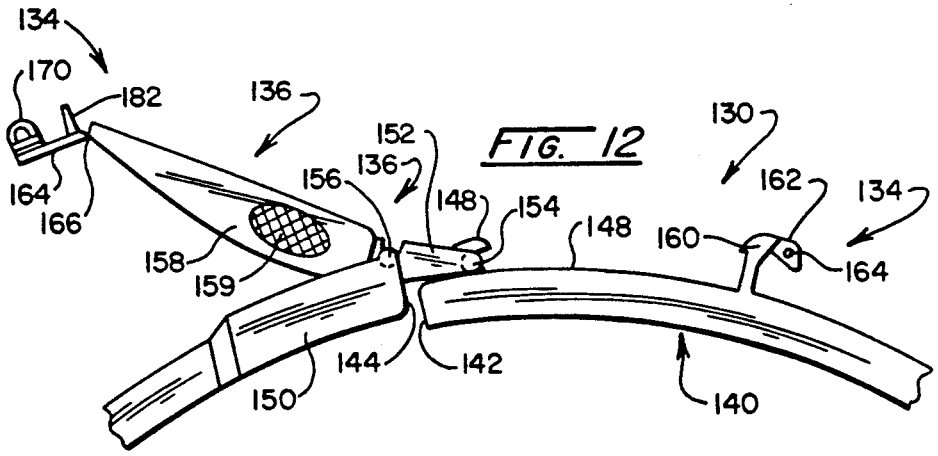
FIG. 12 is a partial side view of another embodiment of a two-piece split ring clamp assembly according to the invention showing the assembly in an open orientation.

Referring to FIGS. 12 and 13, another two-piece split ring clamp structure is revealed generally at 130. The structure 130 is similar to that heretofore described, however, it includes a pivot arm represented generally at 132 which incorporates a tamper evident locking assembly represented generally at 134 and a ring shaft receiving notch 136 which does not include the earlier-described elongate capture region 88 or notch extension 96 associated therewith. The split ring component represented at 140 of the assembly 130, as before, includes a first end 142 and a second end 144. Adjacent the first end 142 and extending from the upper surface 146 of the assembly 140 is a pivot shaft receiving notch 148 structured identically with that earlier described at 60. Similarly, the end 44 of assembly 140 is configured having a receiver channel represented generally at 150 and configured essentially identically as that earlier-described at 62.

The pivot arm 132 is configured in inwardly open channel form as arm 64 is constructed. The ring assembly 140 engaging components thereof include a reduced widthwise section 152 which incorporates the noted ring shaft receiving notch 136 and further includes an arm pivot shaft 154 structured therewith in the same manner as earlier described shaft 84. Similarly, the receiver channel 150 is configured having a ring pivot shaft 156 again, structured identically with earlier-described shaft 80. Adjacent to the reduced widthwise portion 152 of the arm 132, as before, is a lever or handle portion 158 configured substantially as earlier-described so as to achieve the noted over-center compressive association between the shaft 154 and bearing surface 136 enhancing closure and retention of the assemblage. As before, a finger grip region as at 159 may be formed within the sides of lever 198 in similar fashion as region 103 shown in FIGS. 9–11.

Figure 14:
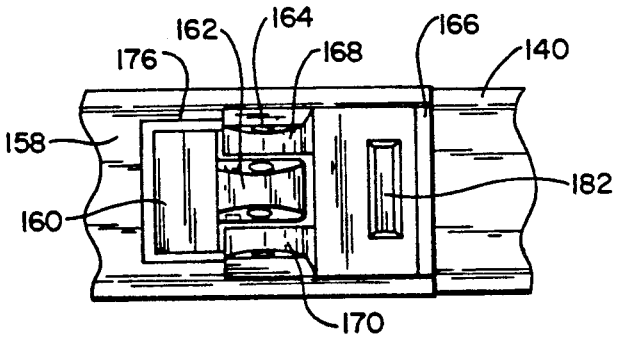
FIG. 14 is a partial side view of the assembly of FIG. 13 showing a tamper evident locking assembly which may be utilized with the split ring clamp assemblies of the invention.
Figure 15:
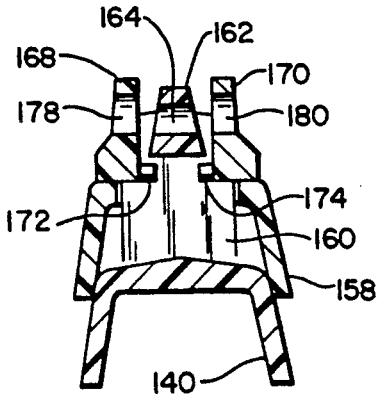
FIG. 15 is a sectional view taken through the plane 15—15 shown in FIG. 13.

The tamper-evident locking assembly 134 is seen in FIGS. 12, 14, and 15 to be comprised of an upstanding stud 160, the uppermost or head portion thereof being formed as a resilient locking detent 162 having a circular passageway 164 passing therethrough. Stud 160 is formed integrally with the ring clamp 140 and cooperates with a locking tab 164 which is hinged by a diminished cross-sectional or notched attachment at 166 integrally formed with the end of lever 158. The locking tab includes spaced upstanding connectors 168 and 170 as seen in FIGS. 14 and 15, the lower portions of which as seen in FIG. 15 include respective detent pins shown in FIG. 15 at 172 and 174 which engage the locking detent 162 upon pivoting the tab 164 over the upper outward side of lever 158. The pivoted orientation is shown, for example, in FIG. 13. An opening seen in FIG. 14 at 176 within the upper surface of lever 158 accommodates entry of the upstanding stud 160 upon closure of the assembly. For the locking assembly 134 to be operated in a temper evident mode, a permanent tie is inserted through the holes 178 and 180 in respective connectors 168 and 170 as well as through the hole 164 in detent 162. Because of this permanent connection, the pivot arm 132 cannot be released for opening until the locking assembly 134 is removed. This is carried out by gripping an upstanding tab 182 integrally molded therein adjacent the hinge region 166 and tearing the assemblage 134 off. While the assembly can be used for locking and reattachment of the lid to a drum thereafter, such attachment is not in conjunction with a locking tab. As is apparent, the tamper evident locking assembly 134 may be employed with any of the embodiments of the two-piece split ring clamp assembly of the invention.

A test carried out with a split ring clamp assembly having a pivot arm structured in the manner as that shown at 132 and having no flexure was observed to fail the four feet inverted drop test described above. A 20 gallon fiber drum filled with a sand and sawdust mixture weighing 200 pounds was the subject of the test with a locking assembly as at 68. Failure was evidenced by the breaking of the safety seal and disengagement of the pivot arm. It is opined that the flexure provided within the region 88 of the pivot arm 64 shown, for example, in FIG. 5, contributes to the shock resistant integrity of that design as well as the feature wherein ring pivot shaft 80 is captured along the extension 96 of notch 92.

Since certain changes may be made in the above apparatus without departing from the scope of the invention herein involved, it is intended that all matter contained in the above description or shown in the accompanying drawings shall be interpreted as illustrative and not in a limiting sense.

We claim:

1. A split ring clamp for retaining a lid upon the rim of a cylindrical container at the interface between, comprising:

an inwardly opening channel-form ring formed of polymeric material having a first end with oppositely disposed side surfaces and upon which an outwardly extending, rearwardly opening pivot shaft receiving notch is integrally formed; said ring having a non-pivoting oppositely disposed second end including an integrally formed receiver channel having oppositely disposed, spaced apart sides defining an outwardly disposed opening said spaced apart sides having mutually inwardly facing internal surfaces slideably movable in adjacency over said side surfaces at said first end, said second end including a ring pivot shaft extending between said spaced apart sides at the outwardly disposed edges thereof; and a pivot arm having a pivot end formed with a transversely disposed arm pivot shaft, a ring shaft receiving notch having a shaft access opening extending to a shaft bearing surface spaced from said arm pivot shaft a distance selected for drawing together said ring first and second ends, and extending therefrom to form a lever, said arm pivot shaft being configured for slideable engagement with said ring first end receiving notch and said ring shaft receiving notch being configured for slideably receiving said ring second end pivot shaft.

2. The split ring clamp of claim 1 in which said ring pivot shaft is formed of said polymeric material integrally with said ring clamp.

3. The split ring clamp of claim 1 in which said pivot arm is formed of polymeric material and said arm pivot shaft is integrally formed therewith.

4. The split ring clamp of claim 1 in which said pivot arm ring shaft receiving notch includes a capture region intermediate said shaft access opening and said shaft bearing surface, for slideably retaining the alignment of said ring pivot shaft with said shaft bearing surface under dynamic shock conditions imposed upon said ring clamp.

5. The split ring clamp of claim 1 in which said pivot arm is configured having parallel side surfaces intermediate said arm pivot shaft and said shaft access opening which are spaced apart a distance selected for effecting pivotal sliding movement within said receiver channel and through said outwardly disposed opening.

6. The split ring clamp of claim 1 in which:

said pivot arm ring shaft receiving notch includes an elongate capture region intermediate said shaft access opening and said shaft bearing surface; and said pivot arm is configured for flexure along said elongate capture region for slideably retaining the alignment of said ring pivot shaft with said shaft bearing surface under dynamic shock conditions imposed upon said ring clamp.

7. The split ring clamp of claim 1 in which said pivot arm lever is structured as a handle formed in the manner of an inwardly opening channel having side members spaced apart a distance selected to permit its slideable nesting adjacency over the outwardly disposed surface of said ring clamp adjacent said first end for effecting an over-center compressive stress within said pivot arm between said arm pivot shaft and said shaft bearing surface.

8. The split ring clamp of claim 1 in which:

said pivot arm transversely disposed arm pivot shaft is cylindrical, having a predetermined diameter; and said rearwardly opening pivot shaft receiving notch is formed having a curved bearing surface of diameter corresponding with said predetermined diameter and having a notch opening of extent less than said predetermined diameter for effecting a flexural capture of said arm pivot shaft upon insertion thereinto.

9. The split ring clamp of claim 1 in which:

said ring includes an integrally formed locking detent component extending outwardly from the outward side of said ring at a location spaced from said first end;

said pivot arm is formed of polymeric material and includes an integrally formed locking tab hinged thereto at the terminus of said lever and pivotally movable into locking engagement with said locking detent component when said pivot arm lever is moved into adjacency with said ring outward side.

10. A two piece split ring clamp comprising:

an inwardly opening channel-form split ring formed of polymeric material having an outward surface and oppositely disposed, spaced side surfaces, having a first end, a rearwardly opening pivot shaft receiving notch upstanding from and formed integrally with said outward surface adjacent said first end, said ring having a non-pivoting second end, an integrally formed receiver channel at said second end having oppositely disposed spaced apart sides defining an outwardly disposed opening said sides having mutually inwardly facing internal surfaces slideably movable into nesting adjacency over said spaced side surfaces and said outward surface at said first end, and a ring pivot shaft integrally formed with said receiver channel extending between said spaced apart sides thereof at the outwardly disposed edges thereof; and a pivot arm formed of polymeric material having a pivot end including an integrally formed, transversely disposed arm pivot shaft inserted within and pivotally movable about said receiving notch of said split ring, a ring shaft receiving notch formed within said pivot arm having a shaft access opening and extending to a shaft bearing surface spaced from said arm pivot shaft a distance selected for drawing together said split ring first and second ends, said shaft bearing surface being pivotally engaged with said ring pivot shaft, said pivot arm extending to an integrally formed lever portion.

11. The split ring clamp of claim 10 in which said pivot arm is configured for flexure in the vicinity of said ring shaft receiving notch for retaining the engagement of said ring pivot shaft therewith.

12. The split ring clamp of claim 10 in which:

said pivot arm ring shaft receiving notch includes an elongate capture region intermediate said shaft access opening and said shaft bearing surface; and said pivot arm is configured for flexure along said elongate capture region for slideably retaining the alignment of said ring pivot shaft with said shaft bearing surface under dynamic shock conditions imposed upon said ring clamp.

13. The split ring clamp of claim 10 in which said pivot arm ring shaft receiving notch includes an elongate capture region intermediate said shaft access opening and said shaft bearing surface for slideably retaining said ring pivot shaft.

14. The split ring clamp of claim 10 in which said pivot arm is configured having parallel side surfaces intermediate said arm pivot shaft and said shaft access opening which are spaced apart a distance selected for effecting pivotal sliding movement within said receiver channel and through said outwardly disposed opening.

15. The split ring clamp of claim 10 in which said pivot arm lever handle is formed in the manner of an inwardly opening channel having side members spaced apart a distance selected to permit its slideable nesting adjacency over the said outward surface and said side surfaces of said ring clamp adjacent said first end for effecting an over-center compressive stress within said pivot arm between said arm pivot shaft and said shaft bearing surface.

16. The split ring clamp of claim 10 in which:

said pivot arm transversely disposed arm pivot shaft is cylindrical, having a predetermined diameter; and said rearwardly opening pivot shaft receiving notch is formed having a curved bearing surface of diameter corresponding with said predetermined diameter and having a notch opening of extent less than said predetermined diameter for effecting a flexural capture of said arm pivot shaft upon insertion thereinto.

17. The split ring clamp of claim 10 in which:

said ring includes an integrally formed locking detent component extending outwardly from said outward surface of said ring at a location spaced from said first end;

said pivot arm includes an integrally formed locking tab hinged thereto at the terminus of said lever potion and pivotally movable into locking engagement with said locking detent component when said pivot arm lever portion is moved into adjacency with said ring outward surface.

18. In a container assembly wherein a cylindrical container is provided having a bottom and cylindrical side walls extending therefrom to a top portion including a rim structure having an upwardly disposed rim bead, an outwardly disposed side surface portion and an inwardly extending engaging region formed inwardly of and below said rim bead and having an upper contact surface, and wherein a lid is provided having a circular peripheral portion positioned over said rim bead in nesting, container closing fashion, the improved split ring clamp for retaining said lid upon said rim structure, comprising:

an inwardly opening, channel-form split ring formed of polymeric material, having oppositely disposed sides and a top, one of said sides being positionable in abutting adjacency against said upper contact surface and the side opposite thereof being positionable in abutting adjacency against said lid peripheral portion, said ring having a first end upon which an outwardly extending, rearwardly opening pivot shaft receiving notch is integrally formed, said ring having a non-pivoting oppositely disposed second end including an integrally formed receiver channel having oppositely disposed, spaced apart channel sides defining an outwardly disposed opening and having mutually inwardly facing internal surfaces slideably movable in adjacency over said sides at said first end, and including a ring pivot shaft extending between said spaced apart sides at the outwardly disposed edges thereof; and a pivot arm formed of polymeric material, having a pivot end formed with a transversely disposed arm pivot shaft, a ring shaft receiving notch having a shaft access opening extending to a shaft bearing surface spaced from said arm pivot shaft a distance selected for drawing together said ring first and second ends to effect securement of said lid upon said rim structure, and extending therefrom to form a lever handle, said arm pivot shaft being slideably engaged with said ring first end receiving notch and said ring shaft receiving notch slideably receiving said ring second end pivot shaft.

19. The container assembly of claim 18 in which said pivot arm ring shaft receiving notch includes a capture region intermediate said shaft access opening and said shaft bearing surface for slideably retaining the alignment of said ring pivot shaft with said shaft bearing surface under dynamic shock conditions imposed upon said ring clamp.

20. The container assembly of claim 18 in which:

said pivot arm ring shaft receiving notch includes an elongate capture region intermediate said shaft access opening and said shaft bearing surface; and said pivot arm is configured for flexure along said elongate capture region for slideably retaining the alignment of said ring pivot shaft with said shaft bearing surface under dynamic shock conditions imposed upon said ring clamp.

* * * * *